United States Patent [19]

Speich

[11] 4,314,588

[45] Feb. 9, 1982

[54] LOOM

[75] Inventor: Francisco Speich, Gipf-Oberfrick, Switzerland

[73] Assignee: Textilma AG, Switzerland

[21] Appl. No.: 113,600

[22] Filed: Jan. 21, 1980

[30] Foreign Application Priority Data

Feb. 15, 1979 [CH] Switzerland ..... 1490/79

[51] Int. Cl.[3] ..... D03C 5/00

[52] U.S. Cl. ..... 139/79; 139/82

[58] Field of Search ..... 139/29, 30, 31, 55.1, 139/57, 58, 79, 81, 82

[56] References Cited

U.S. PATENT DOCUMENTS

| | | | |
|---|---|---|---|
| 413,440 | 10/1889 | Firth | 139/58 |
| 1,595,271 | 8/1926 | Wattie | 139/81 |

FOREIGN PATENT DOCUMENTS

| | | | |
|---|---|---|---|
| 2444411 | 7/1977 | Fed. Rep. of Germany | 139/78 |
| 272551 | 3/1951 | Switzerland | 139/79 |
| 741091 | 11/1955 | United Kingdom | 139/79 |
| 852467 | 10/1960 | United Kingdom | 139/80 |
| 1152069 | 5/1969 | United Kingdom | 139/79 |
| 1344903 | 1/1974 | United Kingdom | 139/436 |
| 1513788 | 7/1978 | United Kingdom | 139/79 |

*Primary Examiner*—Henry Jaudon

*Attorney, Agent, or Firm*—McGlew and Tuttle

[57] ABSTRACT

A loom includes a plurality of reciprocatably displaceable heald devices each generally disposed in a respective one of a plurality of parallel planes, and a plurality of levers each coupled through an intermediate element to a respective one of the heald devices. The respective pivot axis of each of at least two levers is differently spaced from the respective intermediate element to cause a respectively different displacement stroke for each of the at least two heald devices connected thereto. The respective pivot axis of each of the at least two levers is differently spaced from a plane which extends centrally of each heald device, parallel to the line of displacement thereof and perpendicularly to the planes of the heald devices.

9 Claims, 8 Drawing Figures

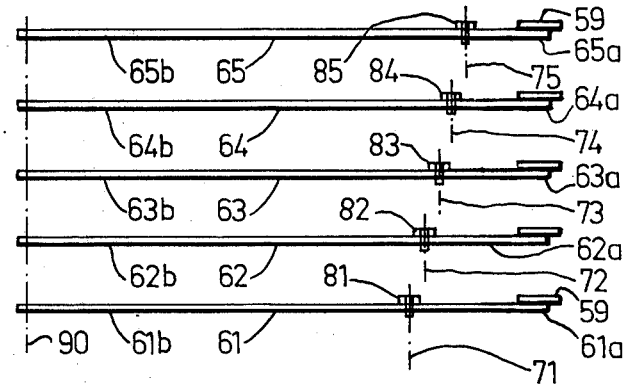
Fig. 3
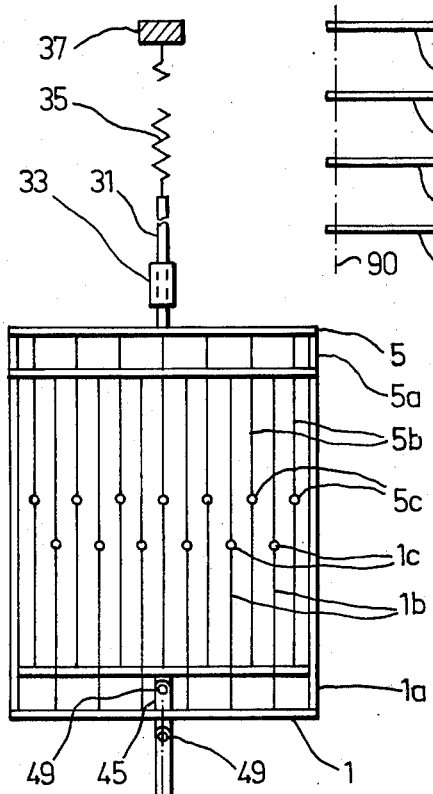
Fig. 2
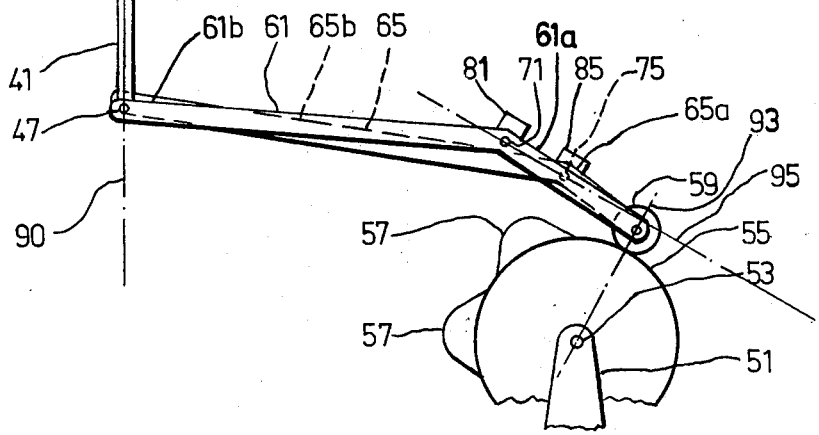

LOOM

BACKGROUND OF THE INVENTION

The present invention relates to a loom.

Looms comprising heald devices of shafts are known, in which for the movement of the heald devices, levers are used. The levers have pivot axes which are aligned with one another and extend at right angles to the planes spanned by the heald devices. When a greater number of heald devices is present in such looms for the weaving of patterned fabric, different heald devices are frequently displaced different distances from their rest positions in the formation of the sheds in order to attain a favorable deflection of the warp threads. In order to produce these different displacements, the levers operatively connected with the heald devices have different lengths. The levers have drive output points, where the levers are connected with the heald devices, which are in most of the levers inevitably removed relatively far from the plane of symmetry of the center plane which extends through the centre points of the heald devices parallel to the direction of motion of the heald devices and at right angles to the planes spanned by the heald devices. In a known type of loom, the levers at the drive output points engage parts which are rigidly fastened to the heald devices. In operation, turning moments arise in respect of the center points of the heald devices. These turning moments must be absorbed by heald device guides and therefore cause noise, increase the wear and limit the maximum possible weaving speed.

In another loom, the levers are connected with the heald devices through flexible tension ropes. Although it is possible in that case to deflect the tension ropes by means of rollers and to fasten the tension ropes to the heald devices in the plane of symmetry or central plane, the additionally necessary deflecting rollers cause the manufacturing costs to be increased. Moreover, tension ropes deflected over rollers tend to deflect out laterally at great speeds, whereby the maximum weaving speed is limited.

SUMMARY OF THE INVENTION

It is an object of the invention to provide a loom in which the heald shafts are displaceable by different distances without the aforementioned disadvantages occurring.

According to the present invention there is provided a plurality of heald devices each reciprocatably displaceable along respective paths and each generally disposed in a respective one of a plurality of parallel planes. The plurality of heald devices are disposed so that a common plane extends centrally of each of the plurality of heald devices, parallel to the paths and perpendicular to each of the parallel planes. Each of a plurality of levers is pivotable about a pivot axis to cause the displacement of a respective one of the plurality of heald devices. Each of a plurality of intermediate elements is connected between a respective one of the heald devices and a respective one of the levers. The pivot axis of at least two levers is differently spaced from the respective intermediate element to provide a different displacement stroke for each which corresponds to at least two heald devices and the pivot axis of each of said levers is differently spaced from said common plane.

Thus, it is an object of the invention to provide a loom having a plurality of heald devices, each of the heald devices being generally disposed in a respective one of a plurality of parallel planes, and each of the heald devices being reciprocatably displaceable along a respective path in its respective one of the parallel planes. The plurality of heald devices is so disposed that a common plane extends centrally of each of the plurality of heald devices. The common plane is disposed parallel to the paths and perpendicular to each of the parallel planes. The loom includes a plurality of levers each pivotable about a pivot axis to cause the reciprocatory displacement of a respective one of the plurality of heald devices. The loom further includes a plurality of intermediate elements each connected between a respective one of the heald devices and a respective one of the levers. The pivot axis of each of at least two of the levers is differently spaced from the respective intermediate element connected thereto so as to provide a respectively different displacement for each heald device connected thereto. The pivot axis of each of the at least two said levers is differently spaced from the common plane.

It is a further object of the invention to provide a loom which is simple in design, rugged in construction and economical to manufacture.

For an understanding of the principles of the invention, reference is made to the following description of typical embodiments thereof as illustrated in the accompanying drawings.

BRIEF DESCRIPTION OF THE DRAWINGS

Embodiments of the present invention will now be more particularly described by way of example and with reference to the accompanying drawings in which:

FIG. 2 shows a side view of the shed-forming device of in FIG. 1, wherein only the foremost and rearmost of the heald devices shown in FIG. 1 are illustrated, FIG. 3 shows a plan view of the levers for displacing the heald devices.

DESCRIPTION OF THE PREFERRED EMBODIMENT

Figure 1:
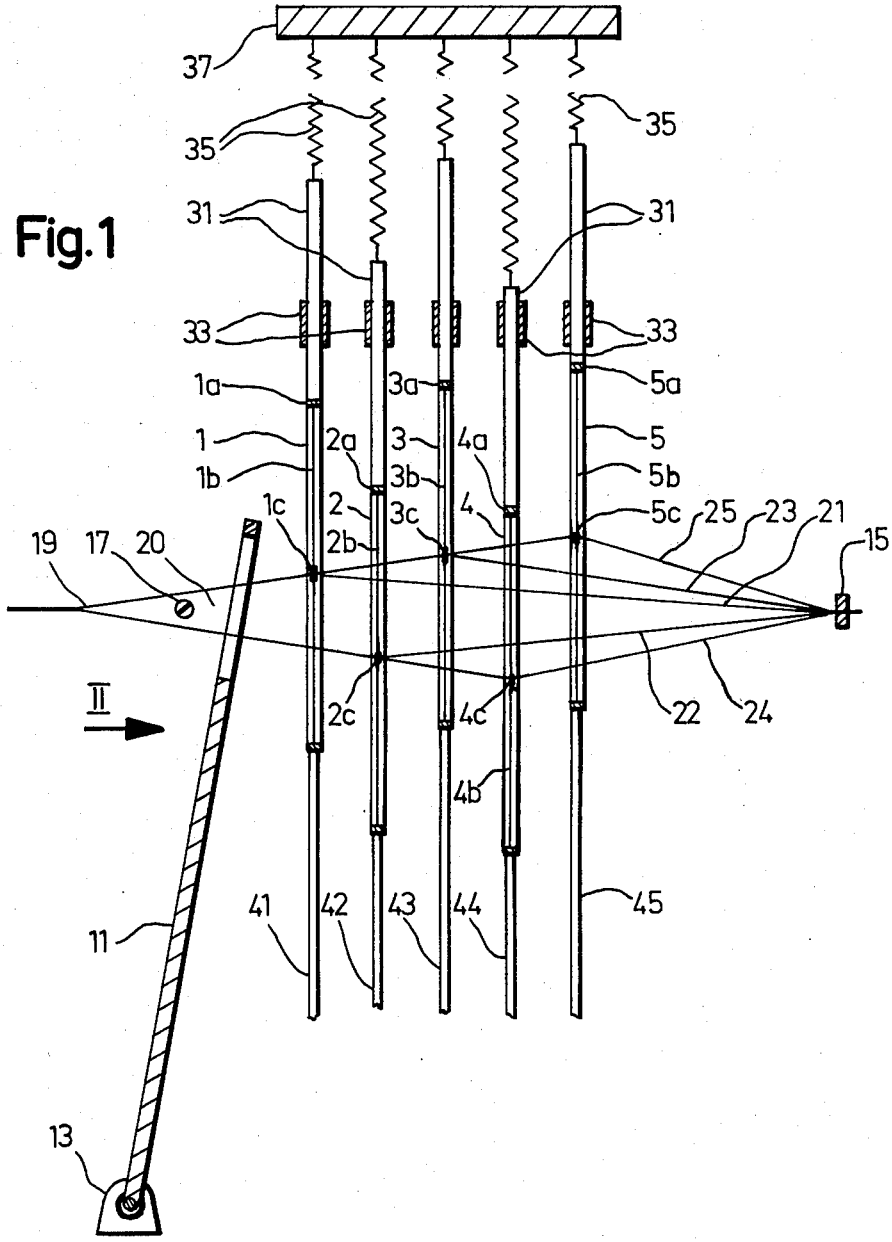
FIG. 1 shows a schematic longitudinal section through a shed-forming device and the shed formed by the device.

FIGS. 1 and 2 show parts of a tape loom including the shed-forming device thereof. The shed-forming device comprises several heald devices or heald shafts are arranged behind one another in the longitudinal direction of the warp threads and of which five are shown in FIG. 1 and designated by 1, 2, 3, 4 and 5. The heald device 1 is disposed foremost, i.e. nearest to a reed 11 which is pivotably mounted in a bearing 13 of the machine frame. The remaining heald devices then follow one another sequentially so that the heald device 5 is furthest from the reed 11. Each device comprises a frame 1*a*, 2*a*, 3*a*, 4*a* and 5*a* and vertically, extending healds 1*b*, 2*b*, 3*b*, 4*b* and 5*b* and with thread guide eyelets 1*c*, 2*c*, 3*c*, 4*c* and 5*c*.

The warp threads are, prior to their entry into the shed-forming device, guided by means of a thread guide 15 so that they lie in, plane. The warp threads then extend through the shed-forming device. In operation, a weft thread loop is introduced into the just formed shed 20 by means of a weft-introducing needle 17 during each shed change. The fabric arising at the reed abutment point 19 is then guided and spooled by means of rollers (not shown).

In the shed-forming device, each warp thread is guided through one of the thread guide eyelets 1*c*, 2*c*, 3*c*, 4*c* and 5*c*. In the formation of a shed 20 the warp threads are deflected in layers by the heald devices, for which the heald device 1 holds the warp thread layer 21, the head device 2 the layer 22, the heald device 3 the layer 23, the heald device 4 the layer 24 and the heald device 5 the layer 25. In the illustrated position of the heald devices, the warp thread layers 22 and 24 form the lower boundary of the shed 20. In the region of the shed 20, i.e. between the foremost heald devices 1 and the abutment point 19 of the reed 11, the lower warp thread layers 22 and 24 lie at least approximately in the same plane. Correspondingly, also the upper warp thread layers 21, 23 and 25 lie at least approximately in the same plane in the region of the shed 20. This deflection of the warp threads is attained thereby due to different displacements of different heald devices.

Vertical rods 31 are fastened to the upper frame limbs of the heald devices 1, 2, 3, 4 and 5. These are guided to be vertically displaceable above the warp threads in schematically illustrated guides 33 fastened to the frame of the loom. Furthermore, only schematically illustrated tension springs 35 are shown, which at one end are fastened to the frame part 37 and at the other end engage at the rods 31 and pull the heald devices upwardly.

A heald device driving means comprises a shaft 53, which is rotatably journalled by means of bearings 51 in the frame of the loom and which extends at right angles to the planes containing the heald devices. A cam disc 55, for each heald device, is fastened rotationally fast on shaft 53. Cams 57 can be mounted on cam disc 55 at points uniformly distributed around the disc circumference. The cams can, for example, be mounted at circumferential points which are spaced from one another by 60° or a multiple thereof. For the remainder, the cam discs and cams are all identically constructed apart from the fact that the different cam discs can be equipped with differently arranged and different number of cams. In particular, all cam discs have the same diameter and all cams the same height.

The heald device driving means furthermore comprises a lever for each heald device. The levers associated with the devices 1, 2, 3, 4 and 5 are shown in FIG. 3 and designated by 61, 62, 63, 64 and 65. The levers are pivotably mounted by pins, the pivot axes of which are designated by 71, 72, 73, 74 and 75, in bearings 81, 82, 83, 84 and 85 fastened on the frame of the loom. Mounted at one end of each lever is a feeler roller 59, which bears against the circumferential surface of the cam disc 55 associated with the lever concerned and tracks the surface.

Guide rods 41, 42, 43, 44 and 45 are each united by means of a hinge pin 47 to a respective lever 61, 62, 63, 64 and 65 at the end of the lever remote from the feeler roller 59. The other end of each of the guide rods are united, by means of hinge pins 49 with straps which are rigidly fastened to the lower frame limbs of the heald devices. As is evident from FIG. 2, the pivot axes of the hinge pins 47 and 49 connecting the guide rods with the levers and heald device, respectively, extend at right angles to the planes containing the heald devices. Furthermore, the pivot axes of the hinge pins 49 lie in the plane extending parallel to the direction of displacement of the heald device, i.e. vertically, which forms a central plane 90 common to all heald devices 1, 2, 3, 4 and 5 as well as a plane of symmetry of the shaft frames. In one or two of the lever positions resulting during the following of the cam discs 55, the guide rods 41, 42, 43, 44 and 45 extend exactly vertically so that then the pivot axes of the hinge pins 47 lie in the central plane 90. In the remaining lever positions occuring in operation, the pivot axes of the hinge pins 47 are slightly displaced from the central plane 90. During the raising and lowering of the heald devices, the hinge pins, which form the drive output points of the levers, thus move along circular arcs which have a tangent as well as chords which run parallel to the central plane 90. Lever arms 61*a*, 62*a*, 63*a*, 64*a* and 65*a*, to which the feeler rollers 59 are journalled, are inclined with respect to the lever arms 61*b*, 62*b*, 63*b*, 64*b* and 65*b* which are connected with the guide rods 41, 42, 43, 44 and 45. The levers are arranged in such a manner that the lever arms 61*b*, 62*b*, 63*b*, 64*b* and 65*b* extend horizontally in the case of the mean pivot positions of the levers occurring in operation, i.e. at right angles to the direction of displacement of the heald devices.

The pivot axes 71, 72, 73, 74 and 75 of the different levers 61, 62, 63, 64 and 65 are disposed at different distances from the common central plane 90 of the heald devices. The feeler rollers 59 of all levers at corresponding lever positions all have approximately the same position with respect to the cam discs. When the feeler rollers 59 have been deflected to approximately half the height of the cams 57, their geometrical axes all lie approximately in one radial plane 93, through which the geometric axis of the shaft 53 extends. The pivot axes 71, 72, 73, 74 and 75 all lie in one plane 95, which extends parallel to the geometric axis of the shaft 53 as well as at right angles to the radial plane 93. At half the deflection of the feeler rollers 59 into half the height of the cam, the axes of the feeler rollers lie at least approximately in the plane 95. The latter thus extends parallel to a tangential plane which touches the cam disc 55 at the radial plane 93. The different levers have different transmission ratios, i.e. they produce different strokes of the heald devices at equal deflections of their feeler rollers 59 forming lever drive points. When, for example, the levers 61 and 65 have been pivoted by identically constructed cams engaging at their feeler roller, the feeler rollers, of both levers are deflected an equal distance measured radially of the shaft 53. Since the lever arm 65*a* on the drive side of the lever 65 is shorter than the lever arm 61*a* on the drive side, the lever 65 is pivoted through a larger angle than the lever 61. Furthermore, the lever arm 65*b* on the output side is longer than the lever arm 61*b* on the output side. Therefore, the hinge pin 47 forming the drive output point of the drive output lever arm 65*b* is displaced in vertical direction through a greater travel than the hinge pin 47 forming the drive output point of the drive output lever arm 61*b*. The positions of the pin axes 71, 72, 73, 74 and 75 are now chosen in such a manner that the heald device strokes become so great that the warp thread layers 22 and 24 as well as also the warp thread layers 21, 23 and 25 in the region of the shed each lie in a common plane and that the axes of the hinge pins 47 each according to the instantaneous lever position lie more or less exactly in the central plane 90.

In operation of the tape loom, the shaft 53 with the cam discs 55 is rotated. Thereby, the heald devices are drawn downwardly against the force of the spring 35 each time the cam 57 of an associated cam disc pivots an associated lever. During a complete revolution of the cam discs, six shed changes and weft insertions take place. Different patterns can thus be produced by appropriate arrangement of the cams on the cam discs.

Since the geometric axes of the hings pins 49 lie in the central plane 90 and this is more or less exactly the case for the hinge pins 47 according to the instantaneous lever position, the levers 61, 62, 63, 64 and 65 or the guide rods 41, 42, 43, 44 and 45, respectively, exert substantially only vertically directed forces, which engage in the central plane 90, on the heald devices. The latter and their guides 33 therefore do not have to absorb turning or tilting moments. Therefore, great weaving speeds are possible. For example, 3000 or more shed changes and weft insertions per minute can readily take place.

Five heald devices are shown in FIG. 1. For the production of complicated patterns, however, more heald devices, for example twenty, can be provided. In that case, each of these heald devices is connected with a separate lever which follows a cam disc. In this case the pivot axis of each lever could also be displaced from that of the adjacent lever. Since in the case of a great number of heald devices they are arranged closely beside one another, for reasons of spacing, it is difficult in some circumstances for all levers to have pivot bearings displaced from one another.

With a great number of heald devices, one can however, construct some adjoining levers identically and journal them on a common hinge pin. For example, between the levers 61 and 62 it is possible to arrange four additional levers which are similar to the lever 61 and also pivotable around the same pivot axis 71. If in an analogous manner four additional levers are arranged beside each of the remaining levers 62, 63, 64 and 65, twenty levers altogether are then present, by which twenty heald devices can be raised and lowered.

The mutually adjacent, identical levers, pivotable about a common pivot axis, also provide equal transmission ratios and heald device strokes. Since the heald devices belonging to one group of identical levers are disposed closely beside one another, only relatively small deviations from the ideal position aimed at, in which all lower and all other warp threads each lie in a common plane, nevertheless arise during the deflection of the different warp thread layers in the region of the shed 20. In so far as the forces exerted on the heald devices are concerned, no turning moments are exerted on the shafts even if a few adjacent levers are pivotable around a common pivot axis, because all levers are connected with a guide rod approximately at the central plane 90.

Figure 4:
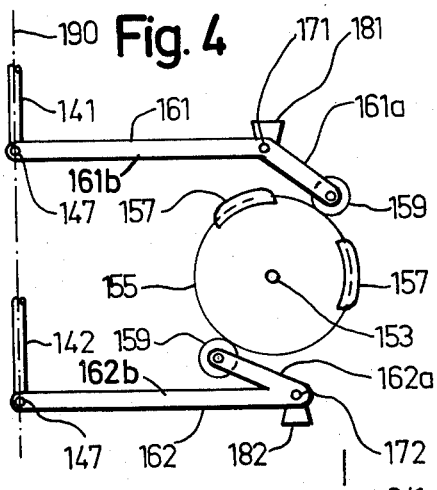
FIG. 4 shows a view of an alternate embodiment of a heald device driving means, in which the levers are arranged on different sides of a cam disc shaft.

When the heald devices are arranged closedly beside one another, the heald device driving means can be constructed as shown in FIG. 4. A shaft 153 is journalled in the machine frame and carries a cam disc 155 fixedly fastened to the shaft to rotate therewith and provided with cams 157.

Two groups of levers are present. The one lever group, of which only the lever 161 is shown, is disposed above the shaft 153 and the cam discs. The other lever group, to which the lever 162 belongs, is disposed below the shaft 153 and the cam discs. Feeler rollers 159, which track the associated cam discs, are journalled on the lever arms 161*a* and 162*a* of levers 161 and 162, respectively. The lever arm 161*b* and 162*b* are connected through a guide rod 141 and 142, respectively, with a heald device (not shown). The geometric axes of hinge pins 147, which connect the levers and guide rods with one another, again in accordance with the instantaneous lever position lie at least approximately in the vertical central plane 190 of the heald devices. The levers 161 and 162 are journalled by means of bearings 181 and 182 in the machine frame, while the pivot axes 171 and 172, about which the levers are pivotable, have different spacings from the central plane 190.

In the heald devices driving means illustrated in FIG. 4, levers or lever groups, which are connected with successive heald shafts or heald device groups, can be arranged alternately above and below the shaft 153. The pivot axes of the upper levers or lever groups as well as also the pivot axes of the lower levers or lever groups are displaced from one another. In this manner, the spacings between the levers or lever groups can be enlarged so that more space is at disposal for the journalling of the levers and the hinge connections between the levers and guide rods.

Figure 5:
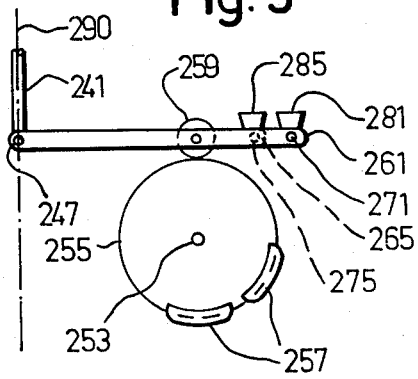
FIG. 5 shows a view of still another alternative embodiment of the heald device driving means with one-armed levers.

The heald device driving means shown in FIG. 5 comprises a shaft 253, journalled in the frame and carrying cam discs 255 provided with cams 257. Several levers are present, of which two are illustrated and designated by reference numerals 261 and 265. The levers each have a respective feeler roller 259 following a cam disc 255. Each lever 261 and 265 is journalled in a bearing 281 and 285, respectively, while the pivot axes 271 and 275 of the levers are disposed at different spacings from the central plane 290 of the heald devices. The levers 261 and 265 are one-armed, i.e. the guide rods connecting them with the heald device, of which the guide rod 241 is visible, are connected by means of hinge pins 247 on the same side of the pivot axes 271 and 275, on which the feeler rollers are also disposed. The axes of the hinge pins 247 again lie at least approximately on the central plane 290.

Figure 6:
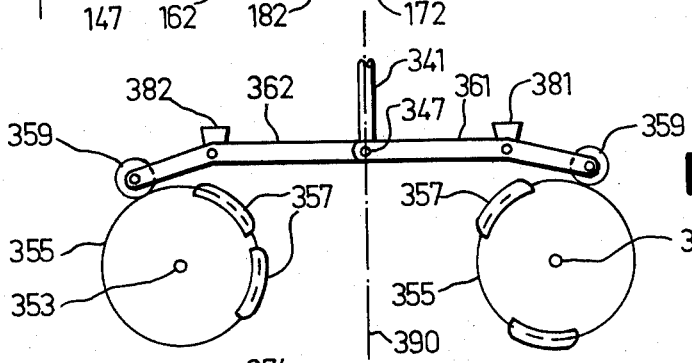
FIG. 6 shows a view of even still another alternate embodiment of the heald device driving means in which the cam discs are arranged on two devices extending parallely beside one another.

The heald device driving means shown in FIG. 6 comprises two shafts 353 journalled in the machine frame and extending parallelly beside one another in a horizontal direction. Several cam discs 355 provided with cams 357 are fastened to each of these shafts. Both the shafts 353 are arranged in mirror image symmetry on different sides of the central plane 390 of the heald device. Serving to follow the cam discs are levers, that include feeler rollers 359, two of which are illustrated in FIG. 6 and designated by 361 and 362. The levers 361 and 362 are journalled by means of bearings 381 and 382, respectively, on the frame of the loom. Illustrated in FIG. 7 in addition to the levers 361 and 362 are two other levers 363 and 364 as well as the shafts 353 of the cam discs, the cam discs themselves being omitted for simplicity. The pivot axes, about which the levers are pivotable, are designated by 371, 372, 373 and 374. The spacings of the pivot axes 371, 372, 373 and 374 from the central plane 390 increase in the sequence of the reference numbers, while successive levers are arranged alternately on different sides of the central plane. Coreespondingly, also the cam disc followed by the feeler rollers 359 of successive levers are likewise arranged alternately on the two shafts 353. Connected to the levers by means of hinge pins 347 are guide rods, of which the guide rod 341 is shown in FIG. 6. The axes of the hinge pins 347 again according to the instantaneous lever position lie more or less exactly in the vertical central plane 390, along which the heald devices are displaced.

Figure 7:
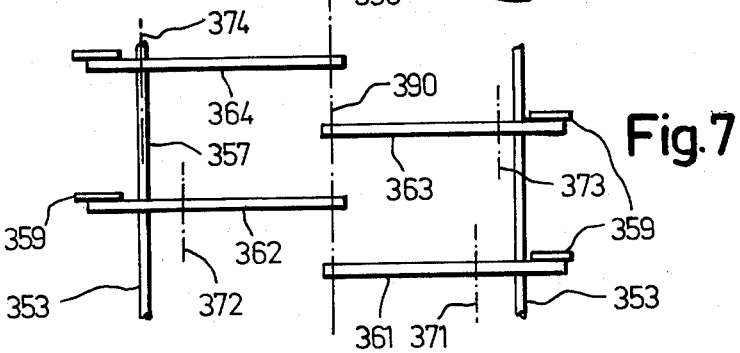
FIG. 7 shows a plan view of the levers of the heald device driving means illustrated in the FIG. 6.

Some adjacent levers can be identical and be pivotable about a common axis in groups in the case of the heald device driving means shown in FIGS. 6 and 7. Since the levers are distributed over two different sides of the central plane 390, they can be employed for the displacement of heald devices disposed relatively closely on one another.

Figure 8:
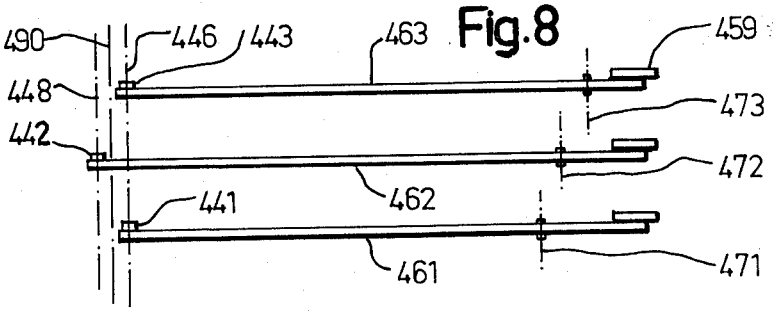
FIG. 8 shows a plan view of the levers of a modification of the heald device driving means, in which the levers engage at the heald device in two planes displaced from one another.

Three levers 461, 462 and 463 each with a respective feeler roller 459 are shown in FIG. 8. The levers are pivotable about pivot axes 471, 472 and 473. The pivot axes 471, 472 and 473 are disposed at different spacings from the central plane 490 of the heald devices. The feeler rollers all have approximately the same spacing from the central plane so that they can follow cam discs which all sit on the same shaft. Approximately vertically extending guide rods 441, 442 and 443 are connected by means of hinge pins (not shown) to the ends of te levers remote from the feeler rollers. The axes 446 and 448 of the joints connecting the guide rods with the levers do not lie in the central plane 490, but are displaced with respect to this on different sides. Due to the axes 446 and 448 being displaced from each other, more space is available for the hinge connections. The spacings of the axes 446 and 448 from the central plane 490 are however, small by comparison with the heald device width measured in the same direction and amount at most to 10% of the heald device width. Only relatively small turning moments are therefore exerted on the heald devices in the arrangement shown in FIG. 8.

In the heald device driving means described with reference to the drawings, the pivot axes of the different levers of the lever groups are thus displaced from one another transversely to the axial direction and have different spacings from the central plane, which is common to all heald devices and runs parallel to the direct on of displacement of the heald devices. During the following of several cam discs, which are arranged on the same or at most on two different devices and are identical apart from the different cams, it thereby becomes possible to attain different transmission ratios of the levers and thereby different heald device strokes and nevertheless to arrange the drive output points of all levers, at which the latter transmit their motion to the heald devices, at least approximately in the central plane. The levers can in that case be arranged in such a manner that their drive output arms extend approximately at right angles to the named central plane. During the pivoting of the levers, their drive output points describe a circular arc which displays a tangent, and preferably also chords, which extend parallel to the direction of displacement of the heald devices as well as the central plane. It thereby becomes possible to transmit the movement of the levers to a point, lying in the named central plane, of the heald devices without turning moments worthy of mention being exerted on the heald devices.

The looms can be modified in different aspects. The number of heald devices can be varied within wide limits in accordance with the desired patterning of the woven fabric. In order that a pattern can be produced at all, several heald devices, i.e. at least three, are of course required. Since a lever is present for each heald device, the number of the levers is of course also to be determined in accordance with the patterns.

The cam pitch divisions can also be varied in the case of the cam discs. At most two, four, six or more cams can be arranged on each cam disc. Furthermore, the levers can be pivoted, instead of by cam discs, by contoured discs or other drive elements, for example, cam chains or punched cards. In all these cases, it is possible to use driving means of like kind for all levers on the driving side, thus for example cam discs or cam chains, which all have identically constructed cams and correspondingly impart approximately equal strokes to all levers.

Furthermore, also the connections between the levers and heald devices can be modified in a different manner. For example, in place of the described guide rods, one could also provide rods rigidly fastened to the heald devices. The lower ends of these rods could then for example be provided with a pin which engages into a slot extending in the longitudinal direction of the drive output lever arm and present in the latter. In this case, the cam discs and bearings of the levers can be fastened to a support which is displaceable transversely to the common central plane of the heald shafts and to the direction of the displacement of the heald devices. Through displacement of the support, the size of the shed, i.e. the opening or angle between the upper and lower warp threads at the reed abutment location 19 could be varied. Another possibility is to provide flexible tension ropes in place of the guide rods.

While specific embodiments of the invention have been shown and described in detail to illustrate the application of the principles of the invention, it will be understood that the invention may be embodied otherwise without departing from such principles.

I claim:

1. A loom comprising:

(a) a plurality of heald devices, each of said heald devices being generally disposed in a respective one of a plurality of parallel planes and each of said heald devices being displaceable for reciprocating displacement along a respective path in its said respective one of the parallel planes, said plurality of heald devices being so disposed that a common central plane extends centrally of each of said plurality of heald devices, said common plane being disposed parallel to said paths and perpendicular to each of said parallel planes, (b) a plurality of levers, each lever being operatively connected to one of the heald devices and pivotable about a respective pivot axis to cause said reciprocatory displacement of a respective one of said plurality of heald devices, each pivot axis of said levers being extended at a right angle said parallel planes, (c) drive means for pivoting said lever, (d) each lever contacting said drive means at a drive input location spaced from the respective pivot axis of said lever by a first distance, (e) a plurality of intermediate elements, each of said intermediate elements being connected between a respective one of said heald devices and a respective one of said levers at a drive output location spaced from the respective pivot axis of said lever by a second distance, and (f) said pivot axis of each of at least two levers being mutually offset relative to each other, said at least two levers having a different ratio of said first distance to said second distance relative to each other so that mutually different stroke transmission ratios for said at least two levers results.

2. A loom as defined in claim 1, wherein in at least one lever position occurring during operation, said drive output locations of said at least two levers lie in a plane extending parallel to said common central plane.

3. A loom as defined in claim 2, wherein in at least one lever operating position said drive output locations of said levers lie in a plane which coincides with said central plane.

4. A loom as defined in claim 1 or 2 or 3, wherein in at least one lever position occurring during operation said drive input locations of said at least two levers are equally spaced from said common central plane.

5. A loom as defined in claim 4, wherein, in at least one possible operating position of the levers, said drive input location of said at least two levers are aligned in a direction which is parallel to said pivot axes.

6. A loom as defined in claim 5, wherein, said mutually offset pivot axes extend in a common plane forming an angle with said common central plane.

7. A loom as defined in claim 6, wherein said drive means comprise cams, and each of said levers having mutually offset pivot axes are pivoted by cams having equal heights, so that different headle device displacements are obtained.

8. A loom as defined in claim 7, wherein said levers comprise two-arm members, and said drive input and drive output locations of each lever being provided at opposite sides of the pivot axis of said lever.

9. A loom as defined in claim 1, wherein each of said lever is disposed such that said respective intermediate element lies in said common central plane.

* * * * *